United States Patent [19]

Peters

[11] Patent Number: 4,939,884

[45] Date of Patent: Jul. 10, 1990

[54] HONEY STICK MACHINE

[76] Inventor: Glenn Peters, 1443 45th Ave., NE, Salem, Oreg. 97301

[21] Appl. No.: 338,988

[22] Filed: Apr. 14, 1989

[51] Int. Cl.[5] ..... B65B 3/04; B65B 43/54; B65B 63/08

[52] U.S. Cl. ..... 53/127; 53/266 R; 53/284; 141/144

[58] Field of Search ..... 53/127, 266 R, 284, 53/440, 469, 479, 547, 567; 141/114, 129, 144

[56] References Cited

U.S. PATENT DOCUMENTS

| | | | |
|---|---|---|---|
| 3,382,644 | 5/1968 | Vogt | 53/266 |
| 3,452,505 | 7/1969 | Hoag | 53/479 X |
| 3,631,903 | 1/1972 | Huggins | 141/144 X |
| 3,914,917 | 10/1975 | Young | 53/479 X |
| 3,923,084 | 12/1975 | Matthews et al. | 141/144 |
| 3,974,623 | 8/1976 | Bate | 53/567 X |
| 4,021,283 | 5/1977 | Weikert | 53/479 X |
| 4,340,096 | 7/1982 | Stoddard | 141/129 X |
| 4,491,159 | 1/1985 | Colacci | 141/144 |
| 4,557,103 | 12/1985 | Schwartz et al. | 53/127 X |

*Primary Examiner*—Robert L. Spruill
*Assistant Examiner*—Beth Bianca
*Attorney, Agent, or Firm*—Charles N. Hilke

[57] ABSTRACT

An apparatus for filling receptacles with honey comprising heating means and pumping means to force the honey in a circular shaped filler with a plurality of feed tubes arranged like spokes on a wheel. A conveyor nestles the receptacles between clogs of the conveyor. As each feed tube is inserted in the receptacle, the receptacle is filled. Additionally, the receptacle, which is moving on the conveyor, causes the filler to rotate so that each successive receptacle is filled by the next feed tube. A bottom sealer and a top sealer gradually squeeze the ends of the receptacle until they are cut and sealed by a current carrying wire.

7 Claims, 2 Drawing Sheets

HONEY STICK MACHINE

BACKGROUND OF THE INVENTION

1. Field of the Invention

This invention generally relates to a receptacle filling apparatus and, more particularly, to apparatus for filling honey into receptacle.

2. Prior Art

It is well known in the prior art that heating honey will decrease its viscosity. Pumps, called honey pumps in the industry, have been used to transfer honey from bulk tanks or barrels for processing. The filling of receptacles has generally been done by gravity with heat. Portion packaging of honey into soft or pillow packaging is known. Finally, sealers using nichrome wire are known in a flat press mode.

U.S. Pat. No. 3,687,175 discloses an apparatus for filling straw-like tubes where a plurality of tubes are simultaneously filled by means of a vacuum. U.S. Pat. No. 4,537,230 discloses a piston dispensing method used to fill tubes. A rotary volumetric piston dispenser is disclosed in U.S. Pat. No. 4,684,040. A pillow package for flowable product is shown in U.S. Pat. No. 3,986,640. Finally, U.S. Pat. No. 4,411,295 discloses a device for equally filling a plurality of containers by gravity feed from a common source.

A constant flow rotary dispenser for filling receptacles is not disclosed.

SUMMARY OF THE INVENTION

An appartus which fills receptacles with a fluid comprising three main elements: (1) means to make fluid flow; (2) means to place fluid in a receptacle; and (3) means to close said receptacle. A pump and a heating source cause the fluid (honey) to flow. A filler with a hub contained a stationary portion and a rotating portion feeds fluid to receptacles moving on a conveyor. An upper sealer and a bottom sealer which squeezes the ends of the receptacle together. A current carrying wire then cuts and seals the ends of the receptacle.

It is an object of this invention to provide a simple, efficient apparatus for filling receptacles with fluid.

It is another object to provide an apparatus for filling receptacles with a sticky fluid.

It is another further object to provide a clean environment for filling receptacles which meets food cleaniness standards.

It is a final object to provide a speedy means for producing a large number of filled receptacles.

DETAILED DESCRIPTION OF THE PREFERRED EMBODIMENT

Figure 1:
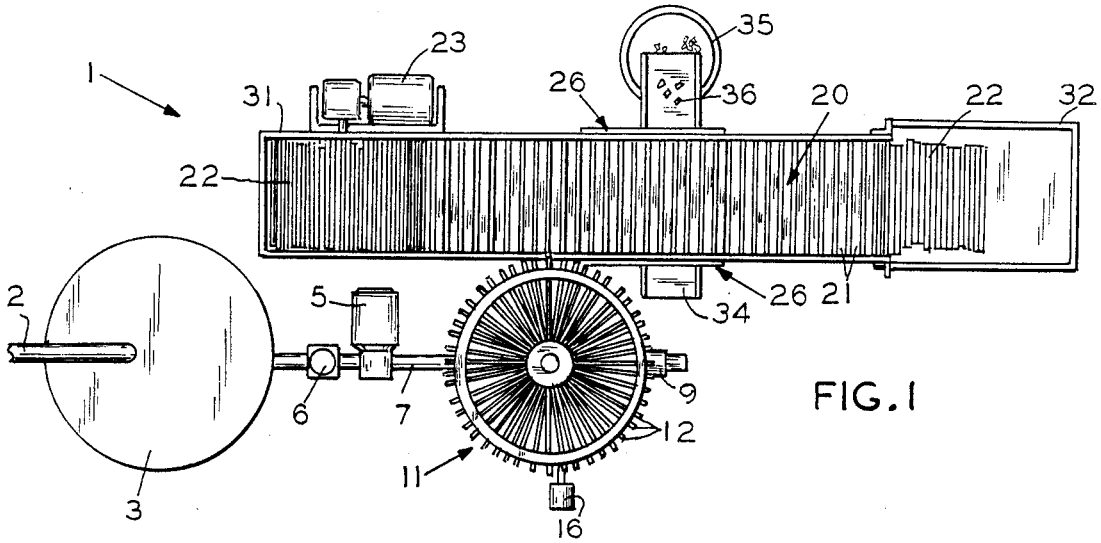
FIG. 1 is a top view of the honey stick apparatus.

FIG. 1 is a top view of the honey stick apparatus 1. Raw honey which may be preheated or at least brought to room temperature is fed into the heating tank 3 by means of the bulk feed pipe 2. An on/off connector valve 6 is placed between the heating tank 3 and the pump 5. The feed pipe 7 directs the flow of honey until it reaches the filler 11. The filler 11 has a number of feed tubes 12, it is preferred that there be 80 feed tubes, which direct the flow of honey to the receptacles 22. The receptacles 22 are deposited on the conveyor 20 such that the receptacles 22 are brought in contact with the feed tubes 12. A receptacle feed box 31 feeds the receptacles 22 onto the conveyor 20. The conveyor 20 is powered by a conveyor power source 23. End sealer 26 which is located on both sides of the conveyor 20 cut and seal the receptacles 22. The receptacle ends 36 fall onto a waste slide 34 which feeds a waste vessel 35. The filled receptacles 22 are then collected in a filled receptacle box 32 at the end of the conveyor 20. A nob 16 allows for the positioning of the filler 11 so that the feed tubes 12 will insert themselves into the receptacles 22. It should be noted that the filler 11 rotates by means of the movement of the receptacles 22 past the filler 11.

Figure 2:
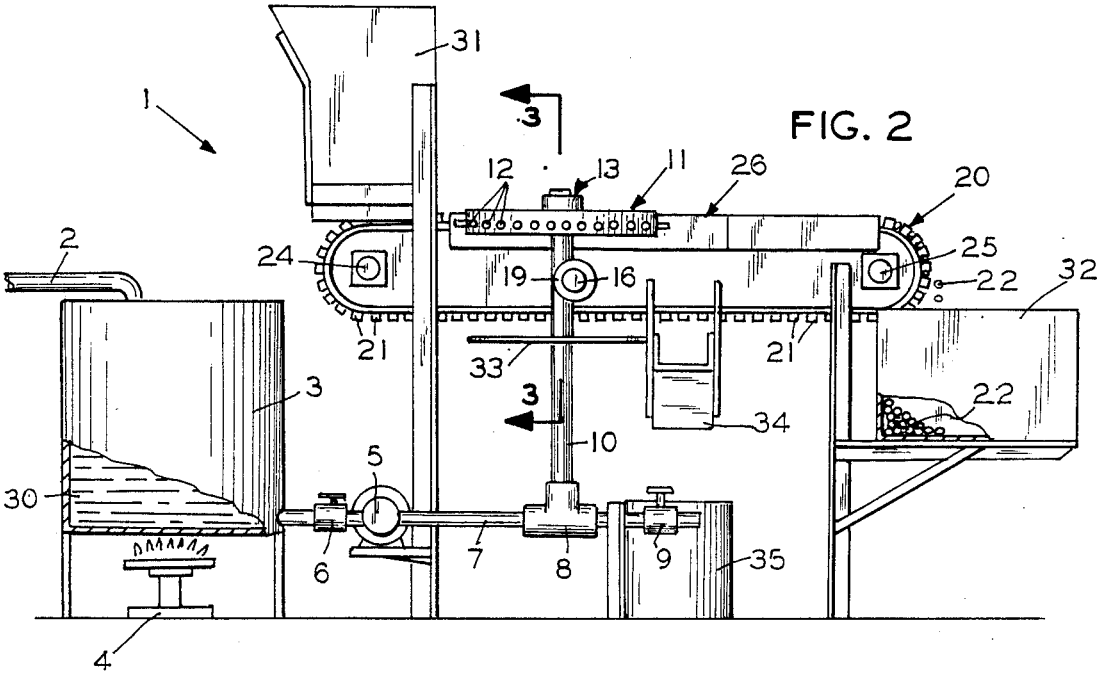
FIG. 2 is a side view of the honey stick apparatus.

In FIG. 2, a side view of the honey stick apparatus 1 is shown. A test source 4 is shown heating the honey 30 in the heating tank 3. The feed line 7 causes the honey to flow into a connector 8 which in turn, provided the clean out spigot 9 is closed, causes the honey to flow up the hub feed 10 which causes the honey to flow into the hub 13. A drip slide 33 is shown which directs overflow honey to the waste vessel 35. The receptacle feed box 31 is shown above the power sprocket 24 of the conveyor 20. The idler sprocket 25 is shown above the filled receptacle box 32 such that the receptacles 22 fall into it.

Figure 3:
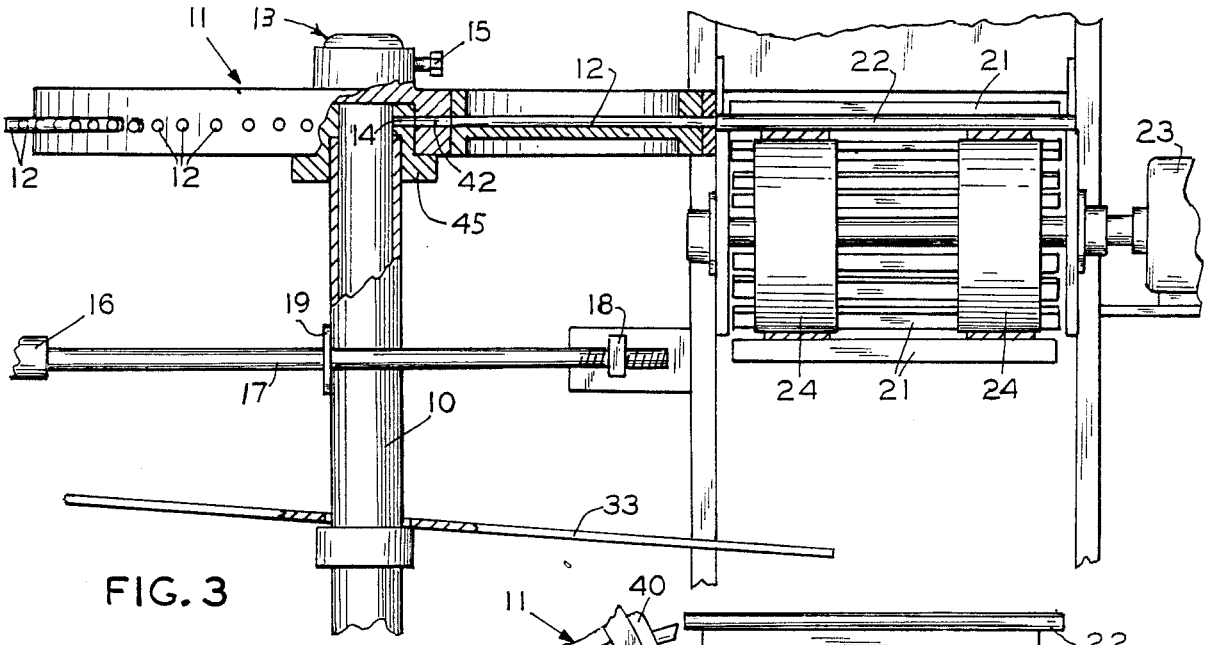
FIG. 3 is a view along lines 3—3 of FIG. 2.

FIG. 3 is a view along lines 3—3 of FIG. 2. The conveyor power source 23 is shown connected to the power sprocket 24. Set screw 15 fixes the hub 13 in place. The feed hole 14, located in stationary hub 45, is shown to direct honey through the hub 13. Knob 16 is shown with screw 17 which is rotatably attached to the nut 18. The hub feed 10 rests against the screw 17 by means of adjustment disc 19. Rotating knob 16 will cause screw 17 to move toward the conveyor 20 or away from the conveyor 20 and thus allow the proper relationship between the feed tubes 12 and the receptacles 22. The drip slide 33 is also shown.

Figure 4:
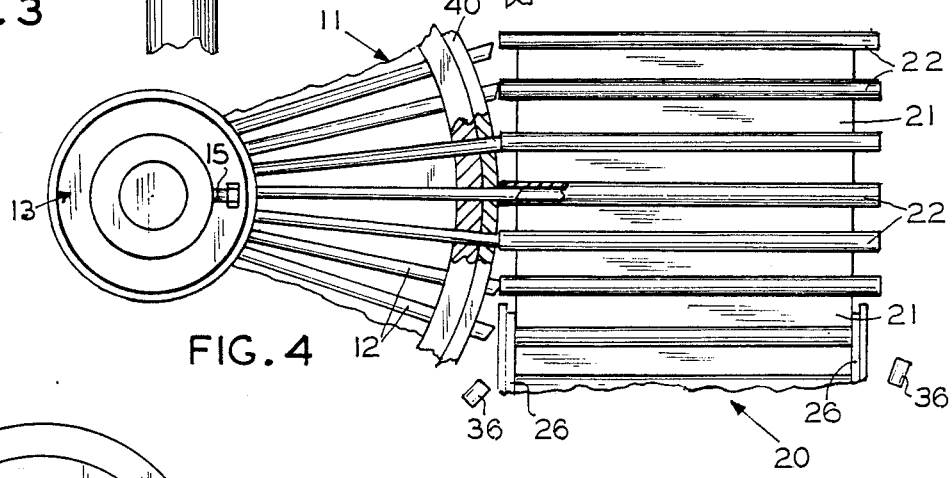
FIG. 4 is a top detail view of the filler and conveyor.

FIG. 4 shows in more detail the operation of the filler 11 with respect to the conveyor 20. The honey by means of the pump 5 is forced through the hub 13 and into the feed tubes 12. Generally, it is preferred that there be 40 intermediate feed holes for 80 feed tubes 12. The outer portion of the filler 11 is covered by a sponge silicon gasket 40. The gasket 40 fits tight against the end of the receptacle 22 during filling. The clogs 21 are shown where the receptacles 22 nestle between the clogs 21. The end sealer 26 is shown on the side of the conveyor 20 with a receptacle end 36 having been cut from the receptacle 22.

Figure 5:
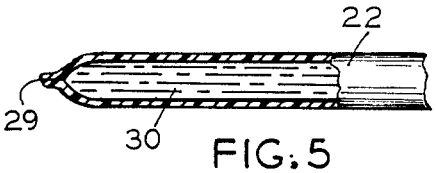
FIG. 5 is a detail view of the end of a filled receptacle.

FIG. 5 shows a receptacle 22 with the receptacle seal 29 and the honey 30 inside.

Figure 6:
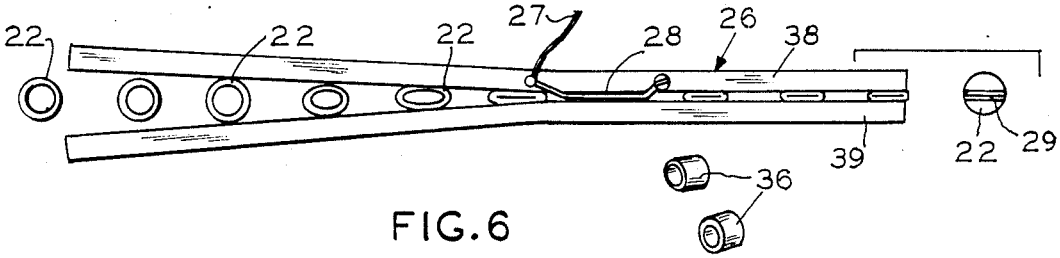
FIG. 6 is a side view of the end sealer.

FIG. 6 is a side view of the end sealer 26. The bottom sealer 39 and a top sealer 38 are attached to the side of the conveyor 20. An electric wire 28 is placed between the top sealer 38 and the bottom sealer 39. Twenty-four volts alternating current is supplied by a transformer (not shown) to the wire 28 by means of transfer wire 27. The receptacles 22 are squeezed into a flattened position to slide between the top sealer 38 and the bottom sealer 39. As the receptacles 22 come in contact with the current carrying wire 28 the ends are sealed (receptacle seal 29) and cut off such that the receptacle ends 36 fall into the waste slide 34 as shown in other figures. It is preferred that the current carrying wire be a nichrome wire.

Figure 7:
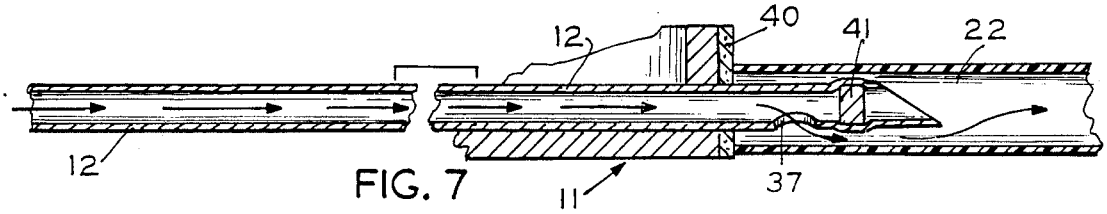
FIG. 7 is a detailed view of a feed tube in a receptacle.

FIG. 7 is a detailed view of the feed tube 12 which shows the honey 30 flowing through it. A stop 41 is inserted at the end of the feed tube 12. A receptacle hole 37 is used to feed the honey into the receptacle 22. Note that the receptacle 22 butts against the sponge silicon gasket 40.

Figure 8:
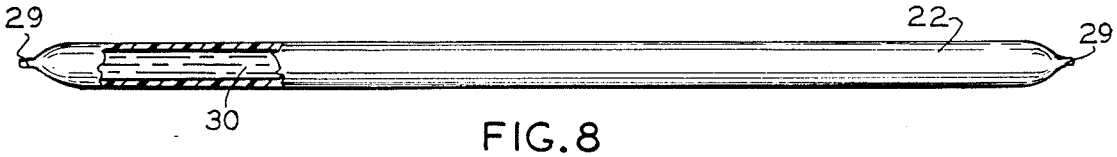
FIG. 8 is a view of the filled receptacle.

FIG. 8 is a view of the receptacle 22 with the honey 30 inside and the receptacle seals 29.

Figure 9:
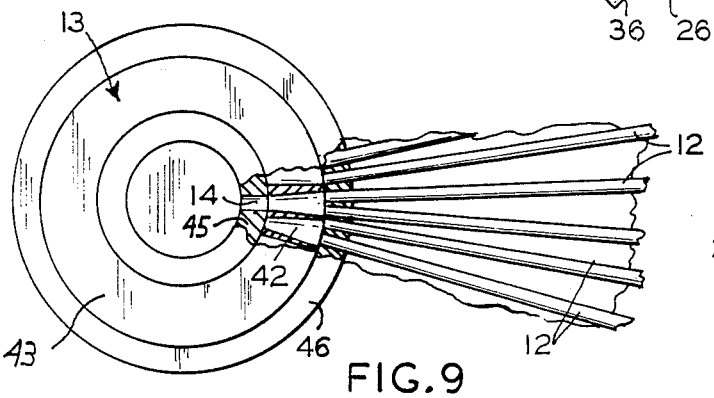
FIG. 9 is a detailed view of the hub and feed tubes.

FIG. 9 is a detailed view of the hub 13. This more clearly shows the feed hold 14, located in the stationary hub 45, which is directed towards the conveyor 20, is shown providing honey to the intermediate feed hole 42 of the intermediate hub 43 which is rotating. The intermediate feed hole 42 provides honey to two feed tubes 12 fit into socket ring 46. It is generally preferred that there be 80 feed tubes bonded to 40 intermediate feed holes. The rotation of the hub 13 is accomplished by means of the positioning of the feed tubes 12 within the receptacles 22 moving on tne conveyor 20.

In operation, the honey is fed either by centrifugal force or another pump to the heating tank 3 by means of the bulk feed pipe 2. A heating source 4 warms the honey 30 in the heating tank 3 so that the honey will flow easily. In addition, filters, commonly known in the industry, are used to filter the honey either before the honey is fed into the heating tank 3 or as it exits the heating tank 3. The one/off connector 6 is opened and the pump 5 is operated which causes the honey to flow through feed pipe 7 to T-connector 8 and then to the hub feed 10. The clean out 9 is in closed position. The knob 16 is positioned so that the feed tubes 12 are engaged in receptacles 22. The power to the sealer 26 is turned on and the conveyor power source 23 is operated. The receptacles 22 are fed from the receptacle feed box 31 by gravity so that one receptacle 22 is positioned between the clogs 21 of the conveyor 20. As the unfilled receptacle 22 moves down the conveyor 20, the end of the feed tube 12 is positioned within the unfilled receptacle 22 such that the end of the receptacle 22 butts against the sponge silicon gasket 40 positioned around the filler 11. The honey then flows from the hub feed 10 into the hub 13 and out of the feed hole 14. The feed hole 14 in the stationary hub 45 is fixably positioned and directed towards the conveyor 20. The intermediate hub 43 and feed tubes 12 are rotating such that the feed hole 14 sequentially feeds honey to each intermediate feed holes 42 which in turn feed two feed tubes 12. The honey 30 as it flows through the feed tube 12 is forced out the receptacle hole 37 by means of the pressure of the pump 5 and the stop 41 located within the feed tube 12. Since the end of the receptacle 22 butts against the sponge silicon gasket 40, the honey 30 is forced to flow through the receptacle 22 to the open end opposite the end being filled. If the feed tube 12 does not engage the receptacle 22, receptacle hole 37 allows the honey to miss the conveyor 20 and flow onto the drip slide 33. As the filler 11 continues to rotate, the supply of honey through feed hole 14 to the particular intermediate feed hole 42 and feed tubes 12 is stopped and the feed hole 14 provides honey to the next intermediate feed hole 42. As the receptacles 22 are moved by the clogs 21 down the conveyor 20, the ends of the receptacle 22 are squeezed between the fixed top sealer 38 and the fixed bottom sealer 39 until they are basically flat as is shown in FIG. 6. The ends of the receptacle 22 will pass in contact with the hot wire 28 which will then both cut and seal the end of the receptacle causing the receptacle ends 36 to fall to the waste slide 34 and finally into the waste vessel 35. Each end of the receptacle 22 is now sealed by the receptacle seal 29. As the receptacle 22 continues along the conveyor 20, it is eventually dropped into a receptacle box 32 at the end of the conveyor 20. If desired, a counter may be placed at the end of the conveyor 20 so that an exact number of receptacles 22 will be counted.

Once the process is completed, the operator will open the clean out valve 9 which causes the honey to flow back out of the filler 11 and down through the hub feed 10 and out the clean out 9. The valve 6 is closed to prevent anymore honey flowing through the system.

Any honey in the receptacle ends 36 and the drip slide 33 is recovered in the waste vessel 35 and may be reprocessed by appropriate heating and filtering.

It will be understood that the embodiments of the present invention which have been described are illustrative of some of the applications of the principles of the present invention. Numerous modifications may be made by those skilled in the art without departing from the true spirit and scope of the invention.

I claim:

1. An apparatus for placing fluid in a receptacle comprising:
   (a) heating means for making the fluid less viscous with pump means to make the fluid flow;
   (b) a conveyer for moving receptacles past filling and closing means;
   (c) a filler with a plurality of feed tubes, each tube adapted to transfer fluid to a receptacle on said conveyor and with a hub where said hub has a stationary portion through which a feed hole extends in a direction generally towards said conveyor and has a rotating intermediate portion with a plurality of intermediate feed holes communicating with said feed hole and with said feed tubes; and
   (d) means to close said receptacle.

2. The apparatus of claim 1, where said feed tubes are engaged within said receptacles by manually aligning the intermediate hub so at least one end of one feed tube is engaged within one end of one receptacle and where the distance between the ends of each successive feed tube is the same distance as between each successive receptacle.

3. The apparatus of claim 2, where said intermediate hub is made to rotate by said feed tubes which are continually sequentially engaged within the ends of said receptacles as said receptacles are moved by said conveyor.

4. The apparatus of claim 1, where the plurality of intermediate feed holes is less than the plurality of feed tubes.

5. The apparatus of claim 4, where there are two feed tubes for each intermediate feed hole.

6. The apparatus of claim 1, where said filler is surrounded on its outer circumference by a gasket and where said receptacle at one end contacts said gasket while filling with fluid.

7. The apparatus of claim 1, where means to close said receptacle comprises an upper sealer and a bottom sealer of gradually closer proximity which squeezes the ends of said receptacle together and a current carrying bare wire which cuts and seals the ends of said receptacle.

* * * * *

UNITED STATES PATENT AND TRADEMARK OFFICE

CERTIFICATE OF CORRECTION

PATENT NO. : 4,939,884

DATED : July 10, 1990

INVENTOR(S) : Glenn Peters

It is certified that error appears in the above-identified patent and that said Letters Patent is hereby corrected as shown below:

In the title of the patent, found at item 54 on the cover page and column 1, line 1, delete "HONEY STICK MACHINE" and please insert --RECEPTACLE-FILLING APPARATUS-- therefor.

In column 1, line 67, delete "the honey stick" and please insert --receptacle-filling-- therefor.

In column 1, line 68, before "Raw honey", please insert --The receptacle-filling apparatus is preferably used to produce HONEYSTIX™-brand honey snacks.--

In column 2, line 22, delete "the honey stick" and insert --receptacle-filling-- therefor.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*